US006357798B1

(12) United States Patent
Chess

(10) Patent No.: US 6,357,798 B1
(45) Date of Patent: Mar. 19, 2002

(54) BUSINESS FORM WITH REPOSITIONAL ADHESIVE LABEL

(75) Inventor: Stanley C. Chess, Jerome, ID (US)

(73) Assignee: Moore Business Forms, Inc., NY (US)

( * ) Notice: Subject to any disclaimer, the term of this patent is extended or adjusted under 35 U.S.C. 154(b) by 635 days.

(21) Appl. No.: 08/778,688

(22) Filed: Jan. 3, 1997

(51) Int. Cl.[7] ..... B42D 15/00

(52) U.S. Cl. ..... 283/81; 40/299.01; 40/630; 281/2; 283/101; 428/42.3

(58) Field of Search ..... 281/2, 5; 283/61, 283/62, 81, 100, 101, 105; 428/40.1, 42.2, 42.3, 43; 40/299.01, 310, 630, 638

(56) References Cited

U.S. PATENT DOCUMENTS

| | | | | | |
|---|---|---|---|---|---|
| 3,351,515 | A | | 11/1967 | Muttera, Jr. | |
| 3,854,229 | A | | 12/1974 | Morgan | |
| 4,747,619 | A | * | 5/1988 | Sager | 283/81 |
| 4,854,610 | A | | 8/1989 | Kwiatek | |
| 4,863,772 | A | | 9/1989 | Cross | |
| 4,932,684 | A | * | 6/1990 | Vermeulen | 283/81 |
| 4,948,450 | A | | 8/1990 | Hurter et al. | |
| 5,238,720 | A | * | 8/1993 | Volkman | 283/101 |
| 5,324,078 | A | * | 6/1994 | Bane | 283/81 |
| 5,466,502 | A | * | 11/1995 | Wilkinson et al. | 283/101 |
| 5,482,328 | A | * | 1/1996 | Stewart | 283/81 |
| 5,484,168 | A | * | 1/1996 | Chigot | 283/67 |
| 5,531,853 | A | * | 7/1996 | Cubow et al. | 156/521 |
| 5,534,320 | A | * | 7/1996 | Raby | 428/42.3 |
| 5,573,621 | A | * | 11/1996 | Boreali | 156/256 |
| 5,630,627 | A | * | 5/1997 | Stewart | 283/105 |
| 5,634,570 | A | * | 6/1997 | Casper et al. | 221/73 |
| 5,639,125 | A | * | 6/1997 | Garrison | 283/101 |
| 5,639,529 | A | * | 6/1997 | Gozdecki et al. | 40/310 |
| 5,792,536 | A | * | 8/1998 | Whipp | 428/43 |

* cited by examiner

*Primary Examiner*—A. L. Wellington
*Assistant Examiner*—Monica Carter
(74) *Attorney, Agent, or Firm*—Nixon & Vanderhye PC

(57) ABSTRACT

An intermediate for making repositional or removable adhesive backed labels is provided which facilitate the construction of labels that may be readily dispensed with automatic equipment, and/or readily passed through printers. A first paper layer has permanent adhesive on a first face and the repositional or removable (preferably repositional) adhesive on a second face, the repositional adhesive also in contact with a first face of a liner material, with a second face of a liner material having a silicone coating. The liner material first face has a non-highly calendered texture, uncoated with adhesive release material so that the repositional or removable adhesive adheres well to the liner material first face, although the repositional adhesive has greater affinity for the first paper layer second face than the liner material first face. The intermediate may be placed in a spiral roll configuration, and then used to make a label precursor by bringing a second paper layer (e.g. about 12 lb. bond paper) into contact with the permanent adhesive layer. Labels are die cut out of the label precursor through the second paper layer so that when the label is removed from the label configuration it has a top face which is a face of the second paper layer and the repositional adhesive defines a bottom face thereof, or the label may be a patch in a much larger business form.

20 Claims, 2 Drawing Sheets

FIG. 4
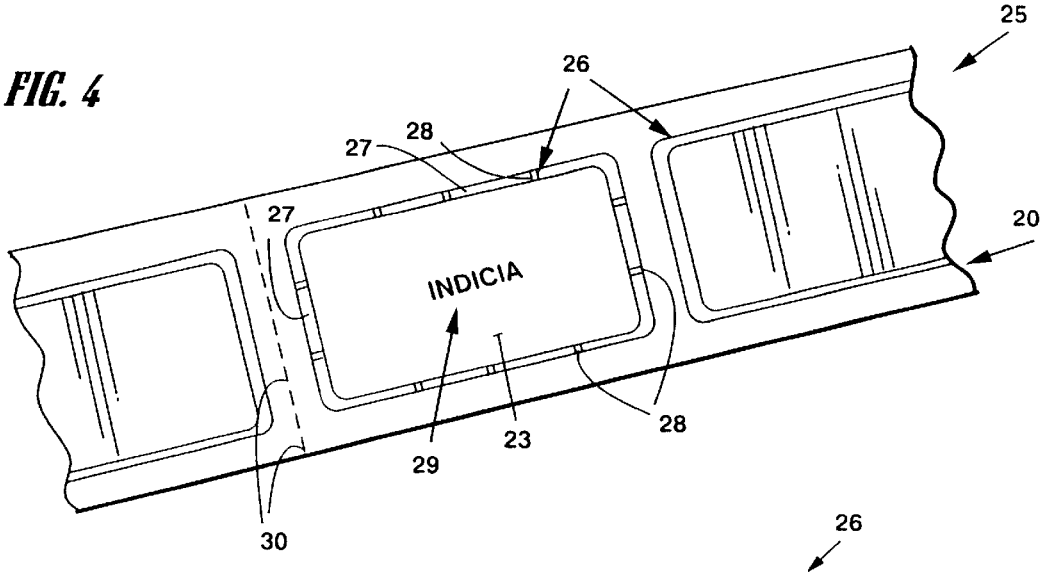
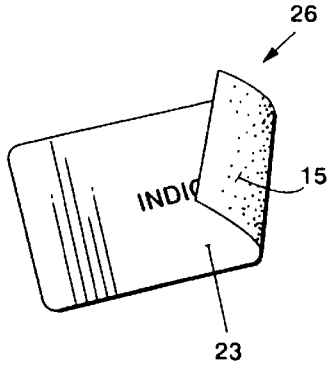
FIG. 5
FIG. 6
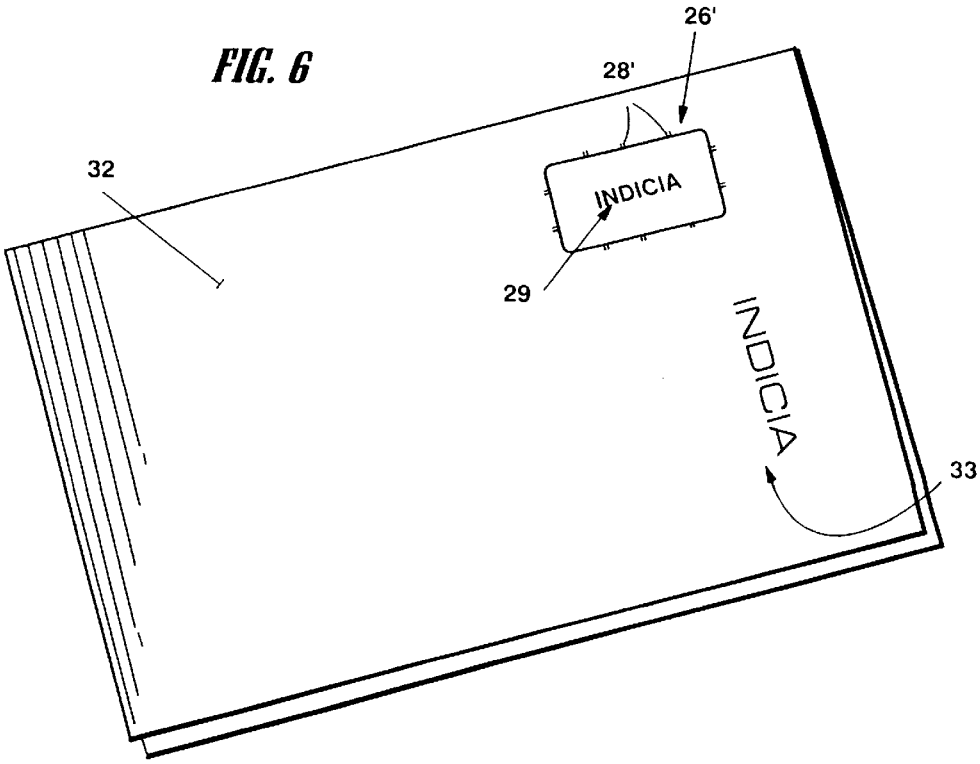

BUSINESS FORM WITH REPOSITIONAL ADHESIVE LABEL

BACKGROUND AND SUMMARY OF THE INVENTION

There are number of situations in which it is desirable to have a paper label with repositional or removable adhesive. One particular effective utilization is where the label is a "patch" in a business form. The intermediate according to the present invention is simple and easy to construct, as is the label precursor formed from the intermediate, and the label configuration pursuant to the invention (whether per se or as a patch in a business form). The label configuration according to the invention may be readily automatically processed, through automatic dispensing equipment, or through printers.

According to one aspect of the present invention an intermediate for making repositional or removable adhesive backed labels is provided. The intermediate comprises the following components: A first paper layer having first and second faces. A liner material layer having first and second faces. A permanent adhesive layer in contact with the first paper layer first face. A repositional or removable adhesive layer in contact with second first paper layer second face and the liner material first face. A permanent adhesive release material layer associated with the liner material second face. And, the liner material first face having a non-highly calendered texture, uncoated with adhesive release material so that the repositional or removable adhesive adheres to the liner material first face even when the intermediate is rolled into a spiral roll configuration, but the repositional or removable adhesive having a higher affinity for the first paper layer second face than the liner material first face.

Typically the release material layer comprises a silicone coating. The repositional or removable adhesive is preferably repositional adhesive. The intermediate may be formed into a spiral roll configuration with the permanent adhesive engaging the release material layer, and unrolled from that configuration to make a label configuration (whether per se or as a patch on a business form) according to another aspect of the invention.

The liner material preferably is as light as possible so that the label constructed will be as thin as possible. In a preferred embodiment the liner material comprises about 25–42 lbs. per five hundred sheet ream (24"×36" sheets) weight liner paper, available from a number of conventional sources. The first surface of the liner material is uncoated with adhesive release material and not highly calendered, otherwise the removable or repositional adhesive—preferably when the clean release preferred repositional adhesive according to the present invention is utilized—would release too easily, and would cause the label to "pre-dispense" in printers while traveling around the printer rollers, for example in the printing of business forms where the label is a patch on a form. That is the first face of the liner material has an essentially "paper" texture that is not exceptionally smooth, like highly calendered paper is. However the liner material typically will be calendered to some extent, and in any event will have a lesser affinity for the removable or repositional adhesive than the paper stock does.

The repositional adhesive preferably utilized according to the invention is CLEAN TAC® adhesive available from Moore Business Communications of Lake Forest, Ill. The intermediate preferably comprises a second paper layer in contact with the permanent adhesive layer to form a label precursor. The second paper layer preferably comprises bond paper having a weight of between about 15–100 lbs. per five hundred sheet ream (17"×22" sheets).

According to another aspect of the present invention a label configuration is provided comprising a label precursor as set forth above, and a label die cut out of the label precursor through the second and the first paper layers so that when the label is removed from the label configuration it has a top face which is a face of the second paper layer, and the repositional adhesive defines a bottom face thereof. The label configuration may comprise a plurality of labels in continuous format (separated by lines of weakness if desired), or preferably the second paper layer comprises a business form having an area at least three times as large as the first paper layer (typically even larger than that, for example the second paper layer comprising an 8 ½×11 inch sheet while the label has a conventional bottle or mailing piece size or the like) as the first paper layer and the liner material so that the label comprises a patch on a business form.

It is the primary object of the present invention to provide an intermediate for constructing a repositional or removable adhesive backed label, and the label configuration so constructed. This and other objects of the invention will become clear from an inspection of the detailed description of the invention and from the appended claims.

BRIEF DESCRIPTION OF THE DRAWINGS

FIG. 4 is a top perspective schematic view of a first embodiment of a label configuration according to the present invention;

FIG. 5 is a top perspective view of an exemplary label from the label configuration of FIG. 4, with the label bent backwardly to illustrate both faces thereof; and FIG. 6 is a view like that of FIG. 4 with a second embodiment of a label configuration according to the invention.

DETAILED DESCRIPTION OF THE DRAWINGS

Figure 1:
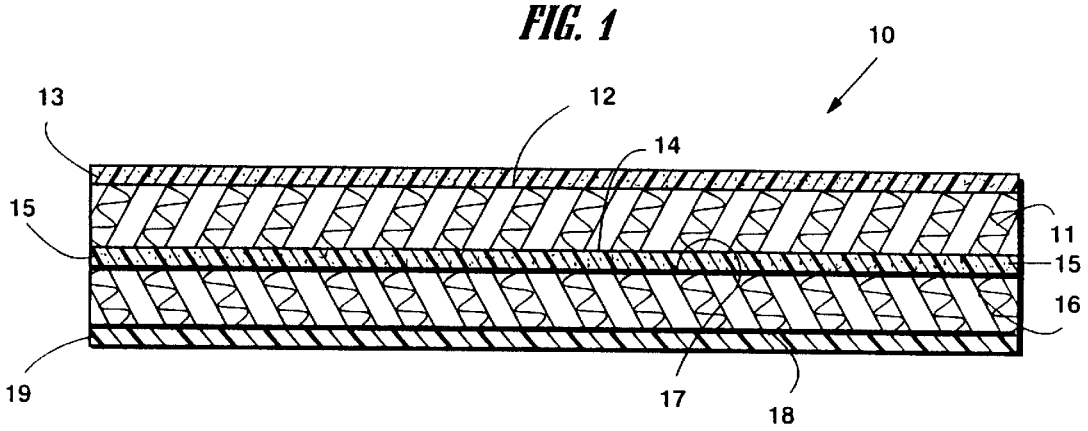
FIG. 1 is a side schematic cross-sectional view, greatly exaggerated in thickness for clarity of illustration, of an exemplary intermediate according to the present invention.

FIG. 1 shows an exemplary intermediate 10 for making repositional or removable adhesive backed labels according to the present invention, FIG. 1 illustrating the intermediate with the various layers thereof greatly exaggerated in size for clarity of illustration. In fact the intermediate 10 will have an actual thickness that is only roughly equal to about the thickness of two conventional sheets of paper.

The components of the intermediate 10 include a first paper layer 11, e.g. bond paper having a weight between about 12–90 lbs. per five hundred sheet ream (17"×22" sheets). Polyester or polypropylene could be substituted for the first paper at between about 0.5 mil to about 4.0 mil thickness. The first paper layer 11 has a first face 12 on which is disposed a permanent adhesive 13, and a second face 14 which is in contact with a removable or repositional adhesive layer 15. The permanent adhesive layer 13 may be any suitable permanent adhesive and the invention is not dependent upon the exact nature of the permanent adhesive.

The adhesive 15 may be of any conventional removable or repositional adhesive used in business forms, labels, or the like, but most desirably is a repositional adhesive and preferably CLEAN TACO® repositional adhesive available from Moore Business Communications of Lake Forest, Ill.

The intermediate 10 also comprises a liner material layer 16 having a first face 17 and a second face 18. The first face 17 is in contact with the repositional adhesive layer 15, while the second face 18 comprises or is in contact with a permanent adhesive release material. For example the face 18 may be highly calendered so that it will release from a particular permanent adhesive 13 utilized therewith, or a silicone release material coating 19 of conventional configuration may be provided thereon.

The liner material 16 preferably is as light as possible so that the ultimate label configuration produced from the intermediate 10 is as thin as possible. For example the liner material may be paper having a weight of between about 25–42 lbs. per five hundred sheet ream (24"×36" sheets). The first face 17 of the liner material 16 has a non-highly calendered texture, uncoated with adhesive release material so that the repositional or removable adhesive 15 adheres to the first face 17 even when the intermediate 10 is rolled in a spiral configuration (see FIG. 2), but the adhesive 15 has a higher affinity for the first paper layer 11 second face 14 than for the liner material 16 first face 17. The face 17 has a basically "paper" texture, however it may have some calendering so that the affinity of the adhesive 15 therefor is less than for the face 14.

Figure 2:
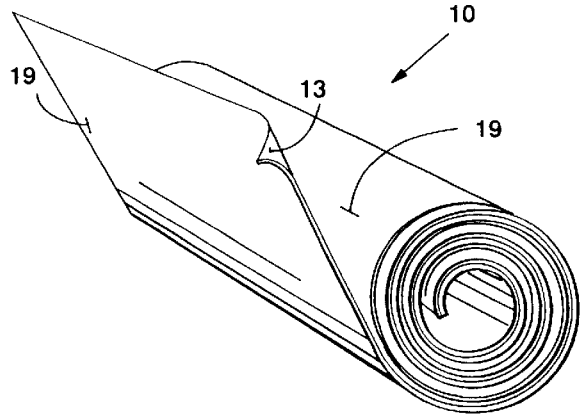
FIG. 2 is a top perspective view of the intermediate of FIG. 1 in a spiral roll configuration.

When the intermediate 10 is in the spiral roll configuration of FIG. 2 it will be seen that the permanent adhesive 13 contacts the silicone release material coating 19 so that the intermediate 10 may be readily unrolled from the configuration of FIG. 2 when it is desirable to form a label precursor and then label configuration according to the present invention.

Figure 3:
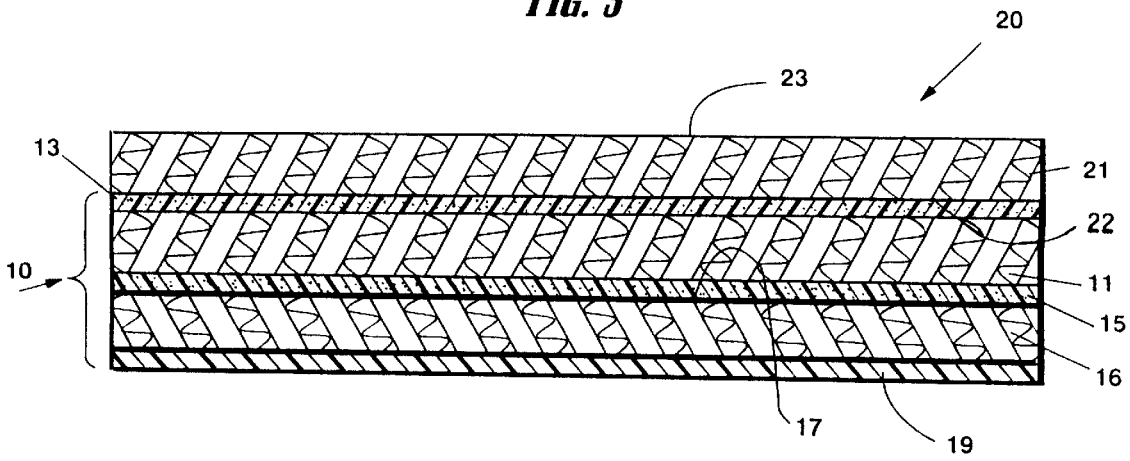
FIG. 3 is a view like that of FIG. 1 only showing the intermediate in association with a second paper layer to form a label precursor.

FIG. 3 schematically illustrates a label precursor 20 according to the present invention, utilizing the same exaggerated thickness format as that for the intermediate of FIG. 1. The precursor 20 comprises the intermediate 10 with a second paper layer 21 in association therewith. The second paper layer 21 includes a first face 22 which engages and is permanently adhered to the permanent adhesive 13, and has an exposed second face 23, typically one in which graphics, text, or the like are imaged.

FIG. 4 shows a label configuration according to the present invention that is made from the precursor 20 of FIG. 3. In the embodiment of FIG. 4 the label configuration 25 has individual labels 26 die cut (through the second paper layer 21 and layer 11) to form the die cuts 27. The die cuts may include paper ties 28 (shown exaggerated in size in FIG. 4) at various positions. The ties 28 are useful particularly if the label configuration 25 is to be passed through a printer or the like to image indicia (such as the indicia 29) thereon. The label configuration 25 includes a plurality of individual labels 26 which are in continuous format, but which may have lines of weakness—such as a perforation line 30—separating the configuration 25 into individual label configurations.

FIG. 5 shows one of the labels 26 according to the present invention detached from the rest of the configuration 25. Because the adhesive 13 has a higher affinity for the first face 22 of paper layer 21 than the adhesive 15 on first paper layer 11 from the liner material 16. When the label 26 is detached from the configuration 25 the repositional adhesive 15 is exposed, and then can be placed in contact with another piece of paper, a physical object, or any other desired element.

FIG. 6 illustrates another embodiment of a label configuration according to the present invention. In FIG. 6 a business form 32 is provided as the second paper layer (21), the business form 32 having an area that is at least three times greater (and typically even greater than that) than the area of the first paper layer 11 and liner material layer 16. In this way the label 26' so formed is a "patch" in the business form 32, the layers 11, 16 having an area that is only slightly (e.g. less than 50%) greater than the area of the label 26' and not visible in FIG. 6 because they are on the opposite of the business form 32. The business form 32 may, for example, be an 8 ½×11 inch, A4, legal size, or like conventional size sheet while the label 26' a standard size of a few inches (normally a maximum of 3×5 inch size). Ties 28' may hold the label 26' securely to the business form 32 to allow it to be readily passed through a laser printer or the like, for the imaging of indicia 33 on the business form 32 (and additionally for imaging the indicia 29, if desired).

The particular manner in which the intermediate 10 is brought into contact with the sheet or strip 21, or the business form 32, is not in any way critical to the invention. It may be done utilizing conventional equipment, such as for applying transfer tape, or for mating together two strips unwound from rolls, or it may be done manually, etc.

It will thus be seen that according to the present invention an advantageous label intermediate, and label configuration, have been provided for a label with repositional or removable adhesive, preferably repositional adhesive. While the invention has been herein shown and described in what is presently conceived to be the most practical and preferred embodiment thereof it will be apparent to those of ordinary skill in the art that many modifications may be made thereof within the scope of the invention, which scope should be accorded the broadest interpretation of the appended claims so as to encompass all equivalent structures and devices.

What is claimed is:

1. An intermediate for making repositionable or removable adhesive backed labels, said intermediate comprising:

a first paper layer having first and second faces;

a liner material layer having first and second faces;

a permanent adhesive layer in contact with said first paper layer first face;

a repositional or removable adhesive layer in contact with said first paper layer second face and said liner material first face;

a permanent adhesive release material layer associated with said liner material second face; and said liner material first face having a non-highly calendered texture, uncoated with adhesive release material so that said repositional or removable adhesive adheres to said liner material first face even when said intermediate is rolled into a spiral roll configuration, but said repositional or removable adhesive having a higher affinity for said first paper layer second face than said liner material first face.

2. An intermediate as recited in claim 1 wherein said release material layer comprises a silicone coating.

3. An intermediate as recited in claim 1 wherein said repositional or removable adhesive is repositional adhesive.

4. An intermediate as recited in claim 1 wherein said intermediate is in a spiral roll configuration with said permanent adhesive engaging said release material layer.

5. An intermediate as recited in claim 1 wherein said liner material has a weight of between about 25–42 lbs. per five hundred sheet ream (24"×36" sheets).

6. An intermediate as recited in claim 1 further comprising a second paper layer in contact with said permanent adhesive layer to form a label precursor.

7. An intermediate as recited in claim 6 wherein said second paper layer comprises bond paper having a weight of between about 15–100 lbs. per five hundred sheet ream (17"×22" sheets).

8. An intermediate as recited in claim 7 wherein said first paper layer comprises bond paper having a weight of between about 12–90 lbs. per five hundred sheet ream (17"×22" sheets).

9. An intermediate as recited in claim 2 wherein said repositional or removable adhesive is repositional adhesive.

10. An intermediate as recited in claim 4 wherein said repositional or removable adhesive is repositional adhesive.

11. An intermediate as recited in claim 5 wherein said repositional or removable adhesive is repositional adhesive.

12. An intermediate as recited in claim 6 wherein said repositional or removable adhesive is repositional adhesive.

13. An intermediate as recited in claim 8 wherein said repositional or removable adhesive is repositional adhesive.

14. A label configuration comprising:

a label precursor comprising:

a first paper layer having first and second faces;

a second paper layer having first and second faces;

a liner material layer having first and second faces;

a permanent adhesive layer in contact with said first paper layer first face;

a repositional or removable adhesive layer in contact with said first paper layer second face and said liner material first face;

a permanent adhesive release material layer associated with said liner material second face;

said liner material first face having a non-highly calendered texture, uncoated with adhesive release material so that said repositional or removable adhesive adheres to said liner material first face even when said intermediate is rolled into a spiral roll configuration, but said repositional or removable adhesive having a higher affinity for said first paper layer second face than said liner material first face; and a label die cut out of said label precursor through said second and first paper layers so that when said label is removed from said label configuration it has a top face which is a face of said second paper layer and said repositional or removable adhesive defining a bottom face thereof.

15. A label configuration as recited in claim 14 wherein said repositional or removable adhesive is repositional adhesive.

16. A label configuration as recited in claim 15 wherein said liner material has a weight of between about 25–42 lbs. per five hundred sheet ream (24"×36" sheets).

17. A label configuration as recited in claim 15 wherein said second paper layer comprises bond paper having a weight of between about 15–100 lbs. per five hundred sheet ream (17"×22" sheets).

18. A label configuration as recited in claim 17 wherein said first paper layer comprises bond paper having a weight of between about 12–90 lbs. per five hundred sheet ream (17"×22" sheets).

19. A label configuration as recited in claim 15 wherein said second paper layer comprises a business form having an area at least three times as large as said first paper layer and liner material so that said label comprises a patch in a business form.

20. A label configuration as recited in claim 14 wherein said second paper layer comprises a business form having an area at least three times as large as said first paper layer and liner material so that said label comprises a patch in a business form.

* * * * *